United States Patent [19]

Halpern et al.

[11] 3,974,655

[45] Aug. 17, 1976

[54] WATER GATE

[76] Inventors: Richard L. Halpern, 3024 NE. 21st St., Fort Lauderdale, Fla. 33305; Carl L. Skiles, 6321 SW. 5th Place, Plantation, Fla. 33317

[22] Filed: Apr. 14, 1975

[21] Appl. No.: 567,760

[52] U.S. Cl. ..... 61/30; 61/8

[51] Int. Cl.[2] ..... E02B 7/04

[58] Field of Search ..... 61/22, 27, 28, 30, 29, 61/64, 1 F, 8

[56] References Cited

UNITED STATES PATENTS

| | | | |
|---|---|---|---|
| 2,568,751 | 9/1951 | Larsen | 61/64 |
| 3,173,269 | 3/1965 | Imbertson | 61/27 X |
| 3,779,020 | 12/1973 | Muramatsu | 61/1 F |
| 3,786,638 | 1/1974 | Fish | 61/30 |

FOREIGN PATENTS OR APPLICATIONS

| | | | |
|---|---|---|---|
| 1,341,032 | 9/1963 | France | 61/27 |
| 1,386,516 | 12/1964 | France | 61/29 |

*Primary Examiner*—Jacob Shapiro
*Attorney, Agent, or Firm*—Carl V. Wisner, Jr.

[57] ABSTRACT

A water gate for a waterway in two species, in one of which an inflatable and deflatable barrier is provided in side and bottom recesses, the gate being in a closed position when the barrier is inflated and an open position when the barrier is deflated, the other of the species providing a curtain which may be raised or lowered by inflating or deflating a balloon disposed at the top of the curtain.

3 Claims, 7 Drawing Figures

WATER GATE

This invention is directed to a gate, usually utilized in pairs, for a waterway connecting two bodies of water. Two types of gates are disclosed, although it is believed they are of the same genus. This application is a companion of our U.S. Pat. No. 3,916,628, issued Nov. 4, 1975, for a water gate. One of the disadvantages of the type of water gate shown in the above-identified application is that for the accommodation of the gate when the waterway is open, land equivalent to the width of the waterway is required. In circumstances where this space is not available, the types of gate shown in this application can be utilized as effective alternatives. This application is further a companion to an application concurrently filed designated as application Ser. No. 567,759, filed Apr. 14, 1975.

BACKGROUND OF THE INVENTION

In many areas, natural lakes occur without natural outlets to other lakes or streams. Developers have found that such lakes can be developed to provide attractive residential lots upon which housing can be located in riparian positions, providing access to the lake for boating. However, such developments, to be attractive to residents, require the installation of lawns, plants, shrubs and trees. Maintenance of this greenery requires continuous application of fertilizers, the runoff from which transports undesirable nutrients to the lake, the result of which is the proliferation of algae and botanicals and pollution in the lake. Governmental authorities exercising jurisdiction over pollution control forbid the connection of such polluted lakes with unpolluted streams or lakes so that boating activities of riparian owners in such polluted lakes are confinded to the lake, which may be of limited extent.

To maximize the enjoyment of such riparian owners, access to other bodies of water is desirable but hitherto has been foreclosed by the objections of such governmental authorities.

Our invention permits the containment of such pollution within the polluted body of water, however, permitting access by such riparian owners to other bodies of water through the means provided.

One of the parameters which must be controlled in provision of gates of the type described in this application or in the co-pending application above identified is the circumstance that seasonal variation between the level of the water of the polluted and unpolluted bodies of water may very substantially by reason of excessive or limited land fall and variables in the rate or extent of evaporation. In some locations, this seasonal variation may be as much as 5 feet. In such circumstances, it is desirable that the gates be arranged so that they will maintain a sufficient free board above whatever the level of water in the waterway may be to insure that at all times the gate will form a barrier to passage of water through the channel.

PRIOR ART

The provision of gates or locks for navigable streams or estuaries is, of course, ancient. Provision of gates which are transverse to a navigable body of water are shown in Seely U.S. Pat. No. 28,201 of May 8, 1860, Pouchet, et al., U.S. Pat. No. 227,831 of May 18, 1880, and Peary U.S. Pat. No. 339,458 of Apr. 6, 1886. None of these are directed to, nor do they provide any suggestion of a solution for, the problems which are resolved by the instant invention.

DESCRIPTION OF THE INVENTION

To permit a pollution-free connection of a polluted with an unpolluted body of water or an estuary or stream, we provide a pair of gates which will confine the pollutants to the polluted body of water and prevent their dissemination to or intrusion into connected bodies of water which would otherwise be pollution-free. The devices about to be described are acceptable to pollution control authorities in the State of Florida where the problem here solved is of wide extent.

As two types of gate are shown in this application, for convenience, the first discussed will be referred to as the "balloon type" and the second discussed as the "shutter type."

Balloon-type Gate

Figure 1:
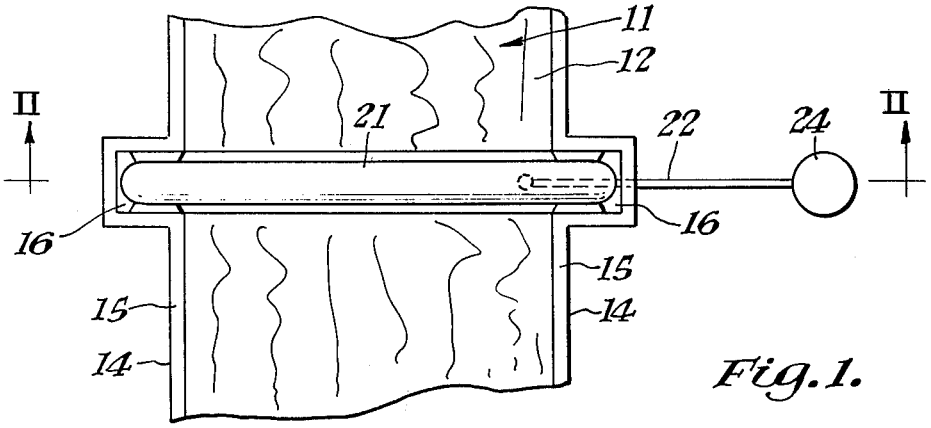
FIG. 1 is a plan view of a channel with a balloon-type gate.
Figure 2:
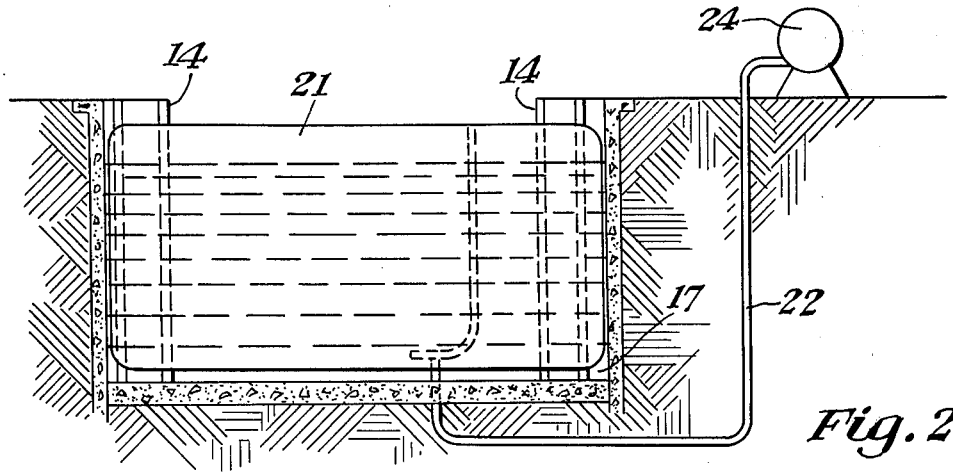
FIG. 2 is a section along the line 2—2 of FIG. 1.
Figure 3:
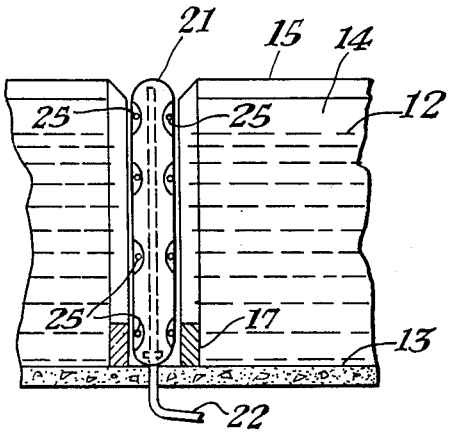
FIG. 3 is a section along the line 3—3 of FIG. 1.

Referring now to FIG. 1, a waterway 11 is shown containing water 12, and a bottom 13, FIG. 3. On the sides of the waterway are bulkheads, 14, 14, normally of sheet piling, protected by a cap, 15, FIGS. 1, 2.

On either side of the waterway are side recesses 16—16, FIG. 1, and at the bottom of the waterway a bottom recess 17 for lodgment of the balloon when the gate is open.

Figure 4:
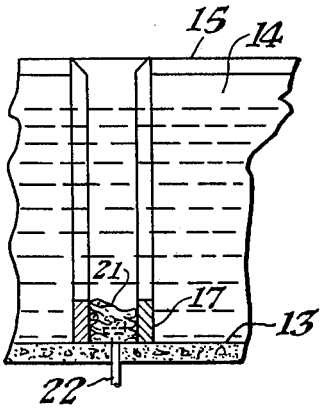
FIG. 4 is similar to FIG. 2, showing the gate open with the balloon in a collapsed condition.

Extending into the side recesses 16, 16, is a flexible water balloon 12, which may be made of such material as Hypalon, a trademarked product of E. I. duPont de Nemours & Co., Inc. When it is in its collapsed condition as shown in FIG. 4, with the waterway open, it is operable by a water-line 22, connected to an interior flexible perforated hose, 23, and activated by a pump, 24. When it is desired to close the gate, the pump, 24, pumps water into the balloon which expands it so that it increases in its dimension to the extent that it provides a closure for the waterway as shown in FIGS. 2 and 3. When it is desired to reopen the water gate, the action of the pump is reversed, water is sucked from the balloon 21, which is carried downwardly by the weights, 25, to lodge in the bottom recess, 17, of the device.

Key-type or radio-type controls, not shown, may be located on either side of the gate on the cap 15 on one of the bulkheads 14, and these should be so activated that the gate closes automatically if the boater neglects to close it.

Shutter-type Gate

Figure 5:
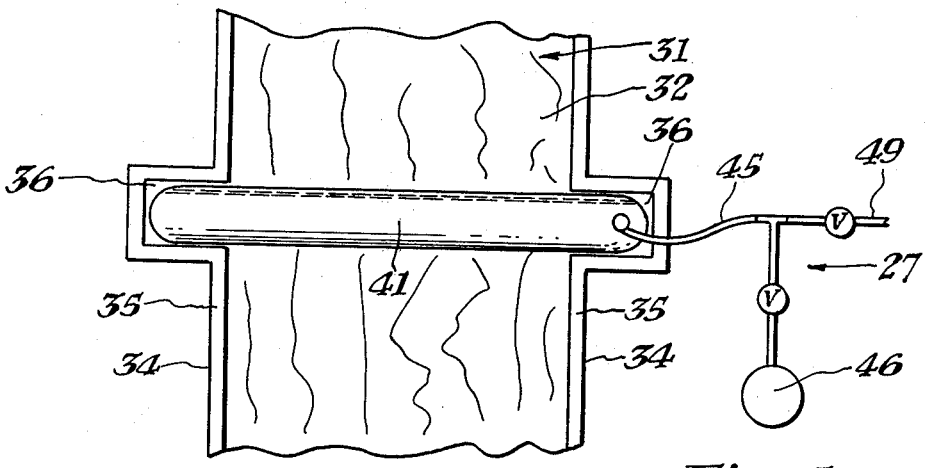
FIG. 5 is a plan view of the shutter type.
Figure 6:
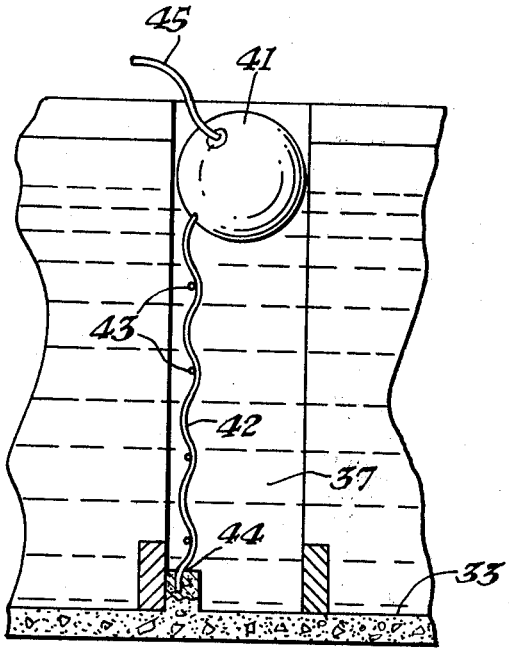
FIG. 6 is a section along the line 6—6 of FIG. 5 showing the gate in a closed position.
Figure 7:
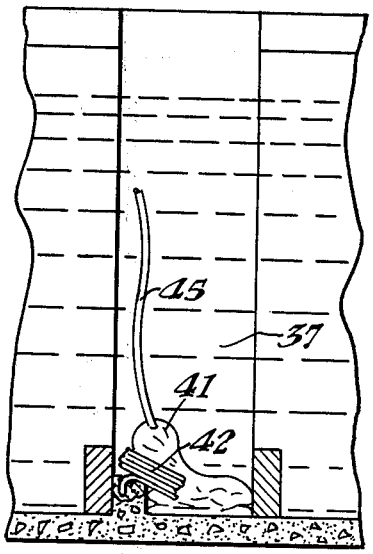
FIG. 7 is a section similar to FIG. 6 but showing the gate in an open position.

Referring now to FIGS. 5, 6 and 7, the construction and operation of the shutter-type gate is now described.

FIG. 5 discloses a waterway, 31, containing water 32, with a bottom 33, bulkheads 34—34, with caps 35—35, side recesses 36—36, and a bottom recess 37.

When the gate is open, lodged in the bottom recess 37 is a deflated balloon 41 attached to a flexible curtain 42, the opposite side of which is fixedly connected to the bottom recess 37 at 44.

When it is desired to close the gate, air under compression in the air compressor and tank 46 through the air-line 45 connected to the balloom 41 by operation of the valves 27, inflates the balloon which raises the shutter to close the waterway. This is effected through operation controls on the bulkhead 48. When it is desired to lower the gate, the operation is reversed, the air is withdrawn from the balloon 41 and bled through the bleeder 49 and the shutter is lowered through the action of gravity on the cross rods 43 to the position shown in FIG. 7.

Having fully described our invention, we claim:

1. Means for retaining pollution in a polluted dominant body of water connected by a waterway to an unpolluted subsidiary body of water and to permit vessels to pass from the dominant to the subsidiary body and from the subsidiary to the dominant body with containment of pollution in the dominant body during such passages, comprising, in combination, a pair of gates disposed sequentially in the connecting waterway, comprising in each gate a pair of vertically disposed recesses in parallel relationship on either side of the said waterway, connected by a horizontally disposed bottom recess, adapted to receive and contain in a collapsed condition a collapsible barrier, buoyant means to elevate the barrier to prevent the flow of water through the waterway, gravity means to lower the barrier to a collapsed condition, and means to add fluid to and withdraw fluid from the buoyant means, said containment being effected during the passage of the vessel by closing the barrier first traversed in said passage before opening the barrier next to be traversed.

2. A structure in accordance with claim 1, in which the collapsible means is composed of a balloon-type structure which, when filled with water, is of sufficient size to engage said side and bottom recesses to provide a barrier to the flow of water in the waterway, said balloon being collapsible by withdrawal of water therefrom to a collapsed condition at the bottom of the waterway, gravity means carried by the balloon to cause the balloon to collapse and descend to the bottom recess as water is withdrawn therefrom, and means to pump water into and withdraw water from the balloon.

3. A structure in accordance with claim 1, in which the collapsible barrier is composed of a flexible curtain, the bottom of which is fixed in the bottom recess, the sides of which ride in the side recesses, buoyant means at the top of said flexible curtain, means to fill the buoyant means with air to elevate the curtain to provide a barrier to the flow of water through the waterway, means to exhaust the air from the buoyant means, and gravity means carried on the curtain to cause the curtain to descend, drawing with it the buoyant means, into the bottom recess when air is withdrawn from the buoyant means.

* * * * *